United States Patent [19]

Yoshida

[11] Patent Number: 4,942,648

[45] Date of Patent: Jul. 24, 1990

[54] SEPARABLE TYPE WATER-RESISTANT SLIDE FASTENERS

[75] Inventor: Hiroshi Yoshida, Kurobe, Japan

[73] Assignee: Yoshida Kogyo K. K., Tokyo, Japan

[21] Appl. No.: 363,992

[22] Filed: Jun. 9, 1989

[30] Foreign Application Priority Data

Jun. 10, 1988 [JP] Japan ..... 63-533705

[51] Int. Cl.[5] ..... A41D 13/00

[52] U.S. Cl. ..... 24/389; 24/388

[58] Field of Search ..... 24/388, 389, 381, 436

[56] References Cited

U.S. PATENT DOCUMENTS

| | | | |
|---|---|---|---|
| 1,813,432 | 7/1931 | Sundback | 24/388 |
| 2,103,037 | 12/1937 | Marinsky | 24/388 |
| 2,289,586 | 7/1942 | Marinsky et al. . | |
| 2,892,231 | 6/1959 | Ulrich et al. | 24/388 |
| 3,030,684 | 4/1962 | John et al. . | |
| 3,618,178 | 11/1971 | Hansen | 24/388 |
| 3,858,283 | 1/1975 | Runnels | 24/388 |
| 4,601,085 | 7/1986 | Yoshida et al. . | |
| 4,658,480 | 4/1987 | Morioka et al. | 24/389 |
| 4,817,252 | 4/1989 | Kusayama | 24/389 |

FOREIGN PATENT DOCUMENTS

| | | |
|---|---|---|
| 0095160 | 5/1983 | European Pat. Off. . |
| 1037388 | 9/1953 | France . |
| 391611 | 5/1933 | United Kingdom . |

*Primary Examiner*—Victor N. Sakran

*Attorney, Agent, or Firm*—Hill, Van Santen, Steadman & Simpson

[57] ABSTRACT

A separable type water-resistant slide fastener includes a separable bottom-end-stop assembly including an insert pin number extending to a predetermined position above the lower end of a stringer tape and a socket member having a slit in the side facing a fastener stringer; and a reinforcing strip having an insert-pin guide extending from the lower end of the insert pin member to the lower end of the one fastener stringer, the insert-pin guide being insertable through the tape-passing gap of a slider into the slit to thereby place the slider and the socket member into coplanar relation to each other; and, when being fully inserted into the socket member, the insert pin member having its upper end lie higher than the upper end of the socket pin member by not less than one inter-element pitch.

3 Claims, 7 Drawing Sheets

SEPARABLE TYPE WATER-RESISTANT SLIDE FASTENERS

BACKGROUND OF THE INVENTION

1. Field of the Invention

The present invention relates to a slide fastener and more particularly to a separable type water-resistant slide fastener having a separable bottom-end-stop assembly.

2. Description of the Prior Art

There are known a number of water-resistant slide fasteners. One example is shown in Japanese Laid-open Patent Publication No. 59-111705, wherein a water-resistant slide fastener stringer comprises a water-resistant stringer tape and a pair of upper and lower rows of synthetic resinous coupling elements mounted on opposite surfaces of the stringer tape along a longitudinal marginal portion thereof, the upper and lower coupling element rows being engageable with a pair of corresponding coupling element rows, respectively, of the like companion stringer, to thus cause a contact edge of the stringer tape engage with the corresponding contact edge of the companion stringer tape, thereby ensuring a water-tightness between the two fastener stringers.

Heretofore, there have existed, indeed, water-resistant slide fasteners having such water-resistant fastener stringers of the non-separable type or the type of having both fastener stringers not separated at their lower ends. However, there has been produced no water-resistant slide fasteners of the separable type or the type that is equipped with a separable bottom stop assembly so that the fastener stringers can be fully separated from their lower ends. This is attributable to there having remained various problems in making separable type slide fasteners of such water-resistant fastener stringers.

Firstly, since the water-resistant stringer tapes are literally made of water-resistant material such as natural or synthetic rubber or other elastomeric synthetic resin and hence considerably rigid, it is very difficult if not impossible to manipulate the separable bottom-end-stop assembly attached to such rigid water-resistant stringer tapes. Particularly, since the water-resistant stringer tapes are too rigid to bend easily, an insert pin member secured to one of the stringer tapes cannot be inserted into a socket member secured to the other stringer tape easily and smoothly.

Secondly, since two or upper and lower fastener element rows mounted on one fastener stringer instead of a single fastener element row must be brought into interdigitating engagement with the two corresponding upper and lower fastener element rows on the other or companion stringer and that simultaneously, this manipulation is very difficult. There is a great difficulty in placing the lowermost elements of one pair of coupling element rows on one stringer into correct engagement with the corresponding lowermost elements of the other pair of coupling element rows on the other stringer; failing which, even if an attempt is made to lift a slider, the slider will never start to ascend for engagement of the coupling element rows. Granting that the lowermost elements on the one stringer engaged correctly with the corresponding element on the other stringer, considerable force would be necessary to start to lift the slider along the coupling element rows.

Thirdly, existence of the two or upper and lower coupling element rows on the opposite surfaces of the stringer tape instead of a single coupling element row on any one surface thereof gives naturally rise to the slider becoming the greater in thickness, so that the slider is apt to be inclined relative to the socket member. As a result, it is very difficult to thread the insert pin member through the thus inclined slider into the socket member.

SUMMARY OF THE INVENTION

With the foregoing drawbacks in view, it is an object of the invention to provide a separable type water-resistant slide fastener with a separable bottom-end-stop assembly wherein an insert pin member is insertable through a slider and a socket member easily and reliably; a slider is easy to start to ascend along coupling element rows; and coupling elements can be brought into reliable engagement with each other.

According to the present invention, the foregoing and other objects are attained by providing a separable type water-resistant slide fastener comprising a pair of fastener stringers including a pair of water-resistant stringer tapes and two pairs of rows of coupling elements each mounted along a respective one of the inner longitudinal marginal portions of and on the opposite or upper and lower surfaces of the stringer tapes; a slider movable reciprocally on and along the coupling element rows to couple and uncouple the same, the slider including an upper and a lower wing joined with each other to define a tape-passing gap therebetween; and a reinforcing strip provided on one fastener stringer to extend from beneath the lower end of the stringer tape to beneath the lowermost element; and a separable bottom-end-stop assembly including an insert pin member formed integrally to the reinforcing strip and extending from beneath the lowermost element down to a predetermined position above the lower end of the stringer tape, a socket member secured to the other fastener stringer in opposite relation to the insert pin member and having a slit in the side facing the one fastener stringer, and a socket pin member secured to the other fastener stringer to project from the socket member; the reinforcing strip having an insert-pin guide extending from the lower end of the insert pin to the lower end of the one fastener stringer, the insert-pin guide being insertable through the gap of the slider into the slit of the socket member to thereby place the slider and the socket member into coplanar relation to each other before threading the insert pin member through the slider into the socket member; and, when being fully inserted into the socket member, the insert pin member having its upper end lie higher than the upper end of the socket pin member by not less than one inter-element pitch.

Many other advantages and features of the present invention will become manifest to those versed in the art upon making reference to the detailed description and the accompanying sheets of drawings in which preferred structural embodiments incorporating the principles of the present invention are shown by way of illustrative example.

DETAILED DESCRIPTION

Figure 1:
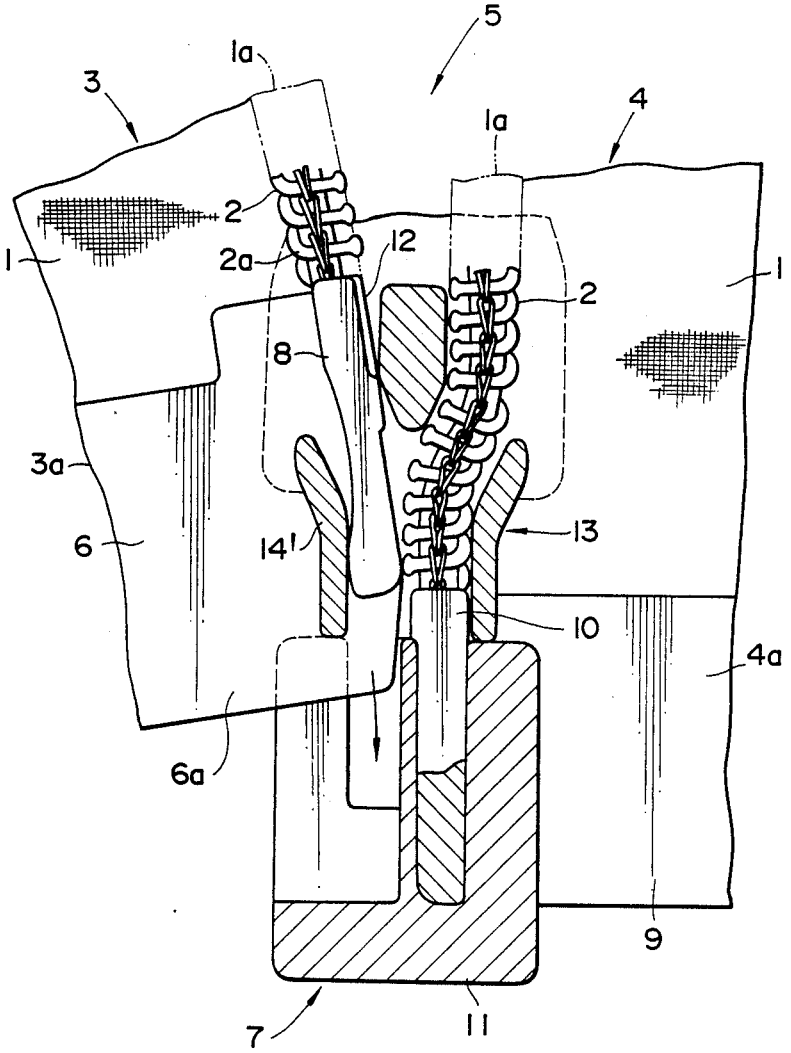
FIG. 1 is a fragmentary front elevational view, partly cross-sectional, of a separable type water-resistant slide fastener having a separable bottom-end-stop assembly according to one preferred embodiment of the present invention.

FIGS. 1 through 10 show a separable type water-resistant slide fastener 5 according to one preferred embodiment of the present invention. As better shown in FIG. 10, the slide fastener 5 generally comprises a pair of slide fastener stringers 3, 4, which in turn comprise a pair of water-resistant stringer tapes 1, 1' coated with elastonomeric synthetic resin such as polyvinyl chloride or synthetic rubber and two pairs of coiled type coupling elements 2, 2' each mounted on and sewn to a respective one of the inner longitudinal edges 1*a*, 1*a*' of and on the opposite or upper and lower surfaces of the stringer tapes 1, 1', the pair of upper and lower coupling element rows 2 on the stringer 3 being engageable with the corresponding pair of upper and lower coupling element rows 2' on the other or the companion stringer 4.

The stringer tape 1 has a reinforcing strip or film 6 of thermoplastic synthetic resin mounted onto the lower portion 3*a* of the fastener stringer 3 by injection-molding in such a manner to extend from the lower end of the stringer tape 1 to beneath the lowermost element 2*a* on the stringer 3. Integrally formed with the reinforcing strip 6 is an insert pin member 8 composing partly a separable bottom-end-stop assembly 7. The insert pin member 8 extends on and along the inner longitudinal marginal portion 1*a* of the stringer tape 1 and contiguous to the lower end of the fastener element rows 2. Likewise, the other stringer tape 1' has a thermoplastic synthetic resinous reinforcing strip or film 9 mounted onto the lower portion 4*a* of the other stringer 4. Integrally formed with the reinforcing strip 9 is a socket member 11 also composing partly the separable bottom-end-stop assembly. A socket pin member 10, the other part of the separable bottom-end-stop assembly 7 is fit into and secured to the socket member 11 to project upwardly from the latter. It is to be noted here that the upper end of the insert pin member 8 lies higher than the upper end of the socket pin member 10 by three pitches of coupling elements when the fastener stringers 3 and 4 come into engagement with each other. The insert pin member 8 is provided, on its side facing the other fastener stringer 4 in its region above the upper end of the socket pin member 10, with an elongate ridge 12 extending longitudinally of the insert pin member 8. The insert pin member 8 extends from beneath the lowermost element 2*a* on the fastener stringer 3 down to a predetermined position above the lower end of the stringer tape 1. Importantly, the remaining part of reinforcing strip which extends from the lower end of the insert pin member 8 down to the lower end of the stringer tape 1 constitutes an insert-pin guide 6*a* which functions to guide the insert pin member 8 when threading the same into the socket member 11 in the manner closely described hereinbelow.

There is a slider 13 mounted on the coupling element rows 2, 2' for reciprocal movement therealong to bring the coupling element rows 2, 2' into and out of engagement with each other. The slider 13 generally comprises a flanged upper wing 14 and a flanged lower wing 15 joined with each other to thus define therebetween a Y-shaped opening for reciprocal movement of the coupling element rows 2, 2' therethrough, there being defined between the respective pairs of lateral flanges 14' and 15', of the upper and lower wing 14, 15, a pair of gaps 13', 13' (only one of them being shown in FIG. 2) for letting the stringer tapes 1, 1' pass therethrough during the reciprocal movement of the coupling element rows 2, 2' through the Y-shaped opening of the slider 13.

The two or upper and lower coupling element rows 2 of the fastener stringer 3 can be simultaneously brought into and out of engagement with the upper and lower coupling element rows 2', respectively, of the other fastener stringer 4 by reciprocally moving the slider 13 along the coupling element rows 2, 2'.

Figure 2:
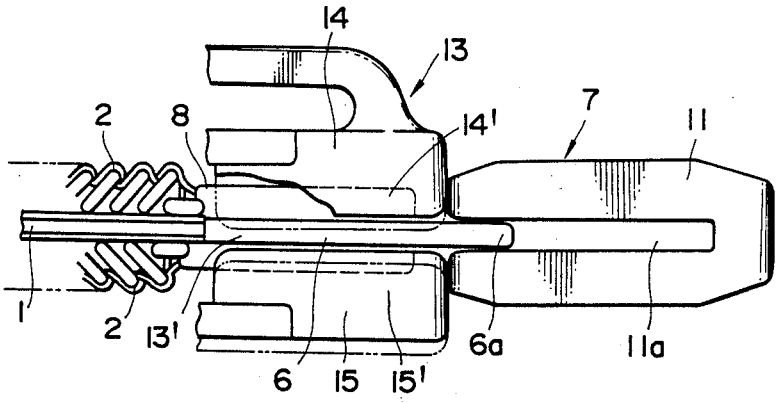
FIG. 2 is a fragmentary side elevational view, partly cut away, of the separable type water-resistant slide fastener of FIG. 1.
Figure 3:
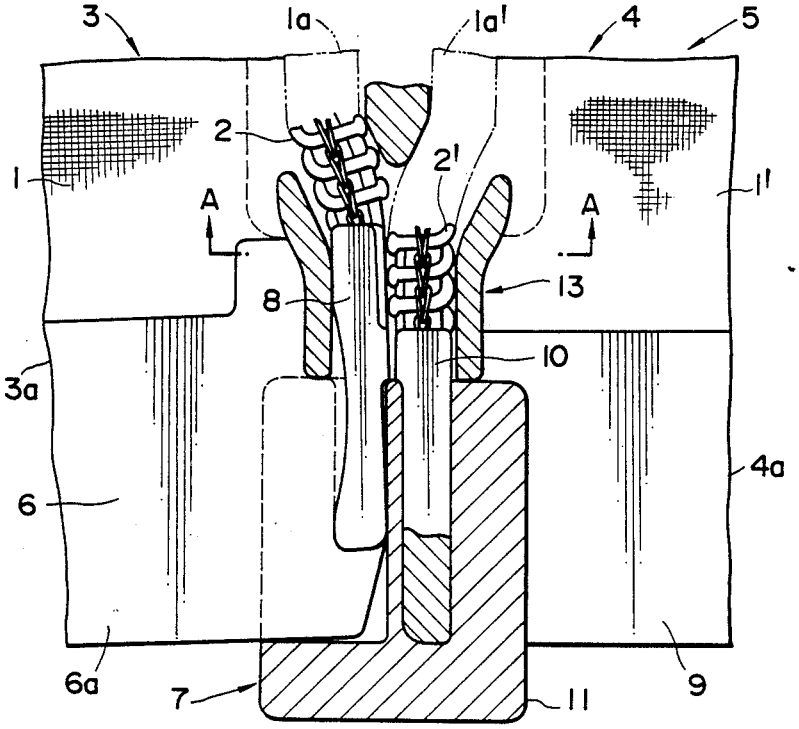
FIG. 3 a fragmentary front elevational view, partly cross-sectional, of the separable type water-resistant slide fastener of FIG. 1 and showing the same standing in another disposition.
Figure 4:
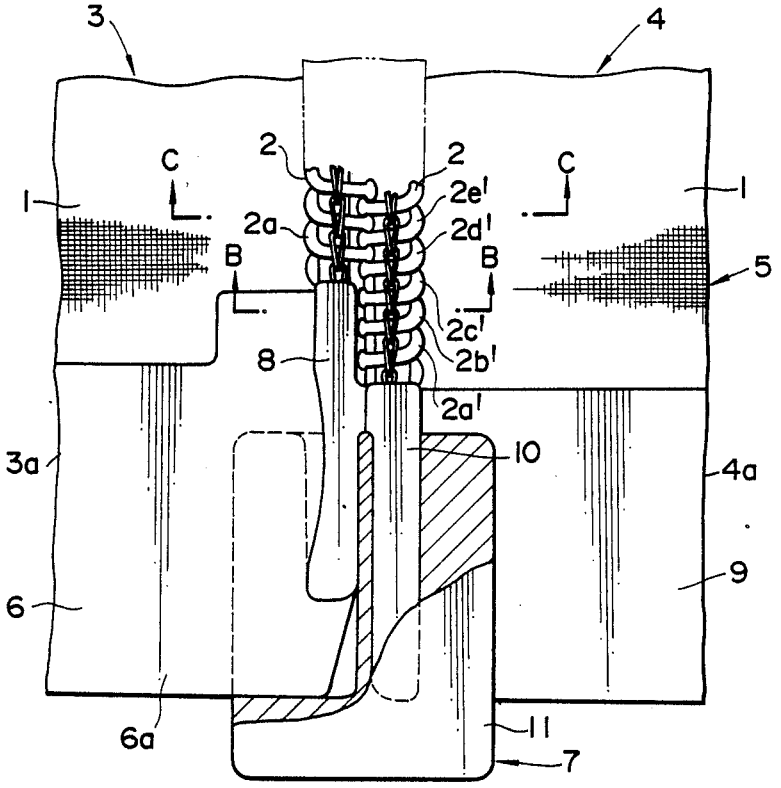
FIG. 4 is a fragmentary front elevational view, partly cross-sectional, of the spearable type water-resistant slide fastener of FIG. 1 and showing the same standing in still another disposition.
Figure 5:
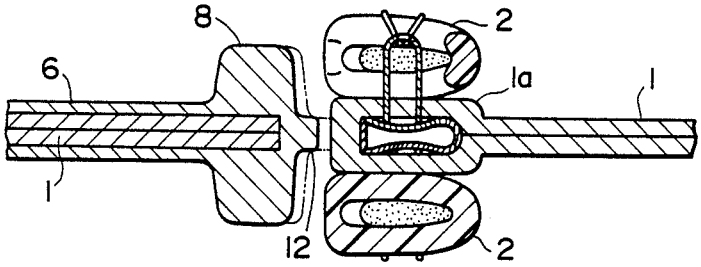
FIG. 5 is a cross-sectional view taken along line A—A of FIG. 3.
Figure 6:
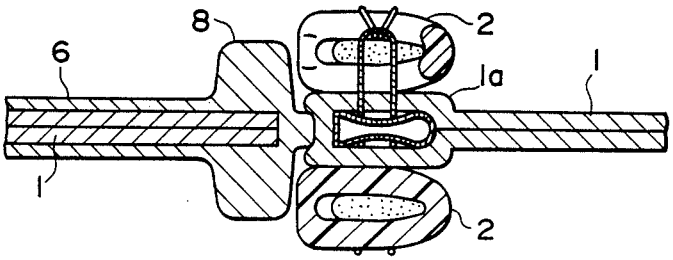
FIG. 6 is a cross-sectional view taken along line B—B of FIG. 4.
Figure 7:
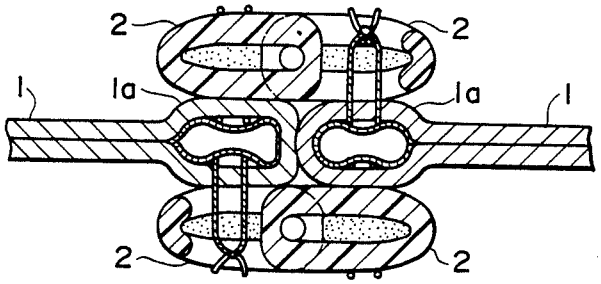
FIG. 7 is a cross-sectional view taken along line C—C of FIG. 4.
Figure 8:
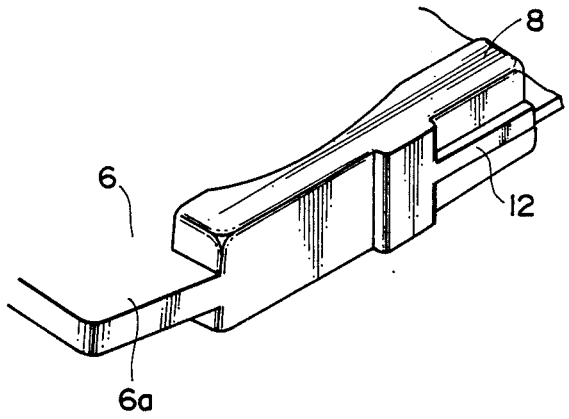
FIG. 8 is an enlarged perspective view of an insert pin member partly constituting the separable bottom-end-stop assembly of the separable type water-resistant slide fastener according to the embodiment.
Figure 9:
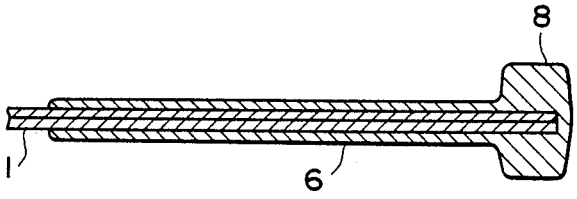
FIG. 9 is a cross-sectional view of a reinforcing strip of the separable type water-resistant slide fastener according to the embodiment.
Figure 10:
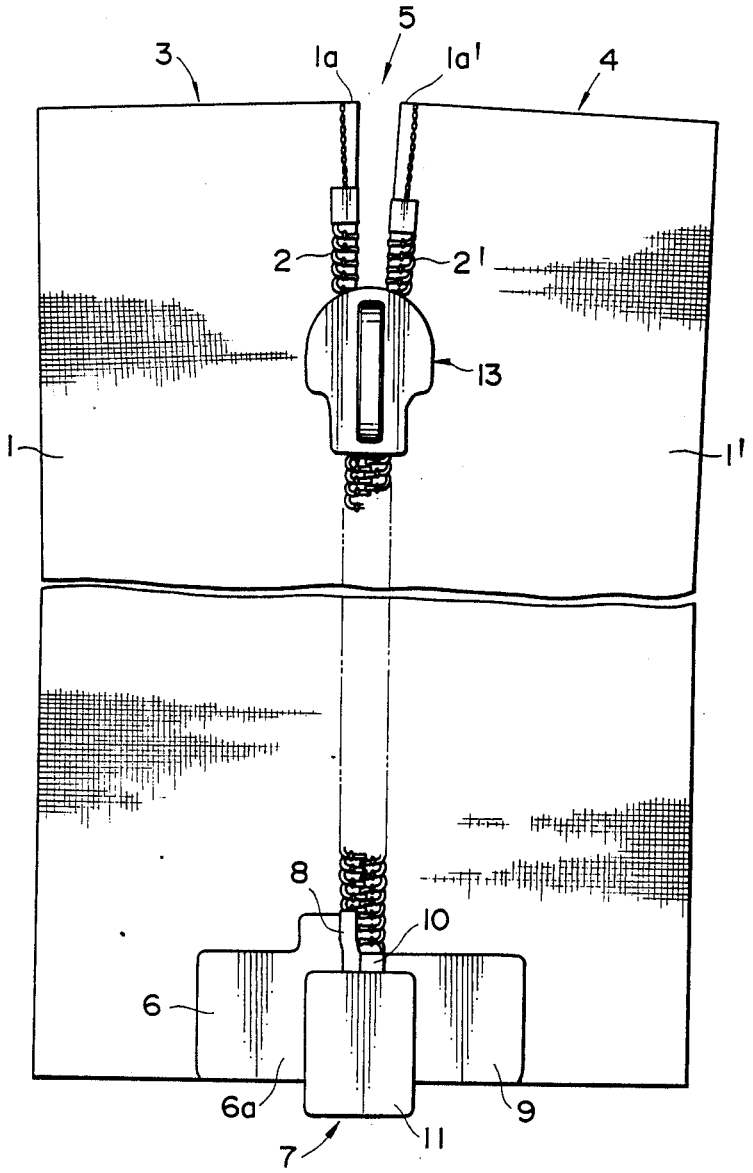
FIG. 10 is a front elevational view, partly left out for brevity, of the type water-resistant slide fastener according to the embodiment.

Turning now to the way to manipulate the separable type water-resistant slide fastener 5 according to the embodiment; first, the fastener stringer 3 is gripped at the reinforcing strip 6, and then the insert pin member 8 is inserted through the Y-shaped opening of the slider 13, with the insert-pin guide 6*a* inserted through the gap 13' between the flanges 14' and 15', as better shown in FIGS. 2 and 3. Then, while rectifying the inclination of the slider 13, the insert-pin guide 6*a* is inserted into the slit 11*a* of the socket member 11, thereby placing the slider 13 and the socket member 11 into coplanar relation to or registry with each other as shown in FIG. 2. With the slider 13 and the socket member 11 thus placed in coplanar relation to or registry with each other by the preceding insert-pin guide 6*a* beforehand, the following insert pin member 8 can be inserted smoothly and unobstructedly into the socket member 11.

Let it be assumed here that there were no insert-pin guide 6*a* on the reinforcing strip 6, in other words, the insert pin member 8 were formed on the stringer 3 in such a manner to extend fully down to the lower end of the stringer tape 1. When the slider 13 were inclined even slightly relative to the socket member 11, the insert pin member 8 would be very likely to be caught and thus prevented from smooth insertion by the inlet edge of the socket member 11.

Then, the insert pin member 8 is fully inserted to the bottom of the socket member 11, so that the insert pin member 8 and the socket member 11 are united to provide the separable bottom-end-stop assembly 7, as shown in FIG. 3. In this disposition, the insert pin member 8 is movable between the position indicated by the solid line and that indicated by the two-dotted chain line in FIG. 5. Ascent of the slider 13 from the separable bottom-end-stop assembly 7 in this disposition causes both pairs of coupling element rows 2, 2' engage each other with a respective one of the stringer tape 1, 1' interposed between each pair of the upper and lower element rows 2, 2', thereby causing the inner longitudinal marginal portions 1*a*, 1*a'* of the stringer tapes 1, 1' intimately contact each other. At this moment, thanks to the upper end of the insert pin member 8 lying higher than the upper end of the socket pin member 10 by three inter-element pitches according to this embodiment, the lowermost or the first element 2*a* on one fastener stringer 3 engages between the fourth and fifth elements 2*d'* and 2*e'* on the other stringer 4. It is to be noted here that the ordinal numbers referring to some coupling elements here are counted from the lower end of each element row. The first elements 2*a'* through the third elements 2*c'* on the other stringer 4 remain uncoupled and hence are entirely free from influence which would be exerted by corresponding elements on the other fastener stringer if coupled; so that not only these elements 2*a'* through 2*c'* but also the fourth and fifth elements 2*d'* and 2*e'* immediately adjacent thereto can maintain their proper positions and inter-element pitches. Since the first element 2*a* on the fastener stringer 3 engages between the fourth and fifth elements 2*d'* and 2*e'* which thus maintain the proper positions and inter-element pitches, the starting step of the engagement can be accomplished smoothly. Besides, as better shown in FIGS. 4 and 6, the first element 2*a'* through the third element 2*c'* on the fastener stringer 4 are disposed in confronting relation to the insert pin member 8 and the inner longitudinal marginal portion 1*a'* of the other stringer tape 1' comes into intimate abutting engagement with the elongate ridge 12 of the insert pin member 8.

With the construction of this embodiment set forth above, even if the stringer tape 1 lacks in flexibility in and around the region of the insert pin member 8, since the insert pin member 8 is threaded into the socket member 11 while well guided by the insert pin guide 6*a*, the threading operation of the insert pin member 8 into the socket member 11 can be effected very smoothly.

Furthermore, since the upper end of the insert pin member 8 lies higher than the upper end of the socket pin member 10 by approximately three inter-element pitches, the threading operation can be effected the more smoothly.

Still furthermore, since the coupling element rows 2, 2' can start to engage with each other easily and reliably, only a little force is required to start to lift the slider 13.

Yet furthermore, according to this preferred embodiment, since the ridge 12 of the insert pin member 8 intimately contacts the inner longitudinal marginal portion 1*a'* of the stringer tape 1', this advantageously provides a water-tightness between the two fastener stringers 3, 4 in the region ranging from the upper end of the insert pin member 8 and the upper end of the socket pin member 11.

Figure 11:
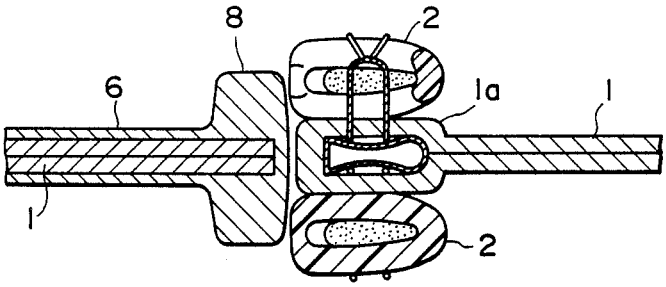
FIG. 11 is a cross-sectional view of a separable type water-resistant slide fastener according to another embodiment of the present invention.

FIG. 11 shows another embodiment of the present invention which is substantially the same as the first embodiment in construction, with the exception that the insert pin member 8 is devoid of a ridge. Despite of absence of a ridge, this separable type water-resistant slide fastener 5 suffices to be used for articles of the nature where water-tightness is not required in the region of its separable bottom-end-stop assembly 7, such as for example, flies or inlet flaps of a tent.

Figure 12:
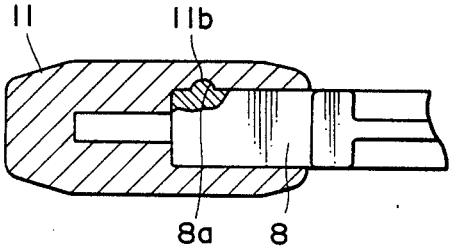
FIG. 12 is a cross-sectional view of a separable bottom-end-stop assembly of a separable type water-resistant slide fastener according to still another embodiment of the present invention.

FIG. 12 shows still another embodiment in which the insert pin member 8 is provided adjacent to its lower end with a protuberant lug 8*a*, while the socket member 11 is provided in its inner side surface adjacent its lower end with a recess 11*b* for fitting engagement with the protuberant lug 8*a*. With this construction, when the insert pin member 8 is fully inserted into the socket member 11, the protuberant lug 8*a* of the insert pin member 8 comes into fitting engagement with the recess 11*a* of the socket member 11, thereby assuredly preventing the insert pin member 8 from accidentally coming off the socket member 11, which otherwise would oftentimes occur particularly when the slider 13 is lifted from the separable bottom-end-stop assembly 7.

The upper end of the insert pin member 8 has only to lie high than the upper end of the socket pin member 10 by not less than one inter-element pitch. The adequate number of inter-element pitches may be selected accordingly.

As set forth hereinabove, since the upper end of the insert pin member lies higher than the upper end of the socket pin member by not less than one inter-element pitch, there arises no mutual interference between adjacent coupling elements when the insert pin member is inserted into the socket member, so that the threading operation of the insert pin member into the socket member can be effected easily and smoothly.

Furthermore, since the first element on one fastener stringer engages the second element or any other element positioned thereabove on the other fastener stringer which is immune from objectionable displacement and disorderly inter-element pitches, misengagement of coupling elements and malfunction of the slider is well prevented, so that smooth and reliable engagement of coupling elements can be accomplished.

The elongate ridge, provided on the insert pin member, can advantageously prevent water from being leaked through between the insert pin member on one fastener stringer and the confronting elements on the other fastener stringer.

Obviously, various modifications and variations of the present invention are possible in the light of the above teaching. It is therefore to be understood that within the scope of the appended claims the invention may be practiced otherwise than as specifically described.

What is claimed is:

1. A separable type water-resistant slide fastener comprising a pair of fastener stringers including a pair of water-resistant stringer tapes and two pairs of rows of coupling elements each mounted along a respective one of the inner longitudinal marginal portions of and on the opposite or upper and lower surfaces of the stringer tapes; a slider movable reciprocally on and along the coupling element rows to couple and uncouple the same, the slider including an upper and a lower wing joined with each other to define a tape-passing gap therebetween; and a reinforcing strip provided on one fastener stringer to extend from beneath the lower end of the stringer tape to beneath the lowermost element; and a separable bottom-end-stop assembly including an insert pin member formed integrally to the reinforcing strip and extending from beneath the lowermost element down to a predetermined position above the lower end of the stringer tape, a socket member secured to the other fastener stringer in opposite relation to the insert pin member and having a slit in the side facing the one fastener stringer, and a socket pin member secured to the other fastener stringer to project from the socket member; the reinforcing strip having an insert-pin guide extending from the lower end of the insert pin member to the lower end of the one fastener stringer, the insert-pin guide being insertable through the gap into the slit to thereby place the slider and the socket member into coplanar relation to each other before threading the insert pin member through the slider into the socket member; and, when being fully inserted into the socket member, the insert pin member having its upper end lie higher than the upper end of the socket pin member by not less than one inter-element pitch.

2. A separable type water-resistant slide fastener according to claim 1, wherein the insert-pin member is provided, on the side facing the other fastener stringer in the region above the upper end of the socket pin member, with an elongate ridge extending longitudinally of the insert pin member for intimate abutting engagement with the confronting inner longitudinal marginal portion of the other stringer tape.

3. A separable type water-resistant slide fastener according to claims 1 or 2, wherein the insert pin member is provided on its one side adjacent to its lower end with a protuberant lug, while the socket member is provided in its inner side surface adjacent its lower end with a recess for fitting engagement with the protuberant lug.

* * * * *

UNITED STATES PATENT AND TRADEMARK OFFICE

CERTIFICATE OF CORRECTION

PATENT NO. : 4,942,648

DATED : July 24, 1990

INVENTOR(S) : Hiroshi Yoshida

It is certified that error appears in the above—identified patent and that said Letters Patent is hereby corrected as shown below:

On the Title page, item [30], Priority No. should read --

63-144292--

Signed and Sealed this

Twenty-ninth Day of June, 1993

Michael K. Kirk

*Attest:*

MICHAEL K. KIRK

*Attesting Officer*

*Acting Commissioner of Patents and Trademarks*